United States Patent [19]

Matteson

[11] 4,449,939

[45] May 22, 1984

[54] SAFE-ARM TRAINING SIMULATOR

[75] Inventor: William R. Matteson, Ridgecrest, Calif.

[73] Assignee: United States of America as represented by the Secretary of the Navy, Washington, D.C.

[21] Appl. No.: 502,404

[22] Filed: Jun. 8, 1983

[51] Int. Cl.[3] ..... F41F 27/00; G09B 9/00

[52] U.S. Cl. ..... 434/12

[58] Field of Search ..... 434/12, 13, 24, 16; 89/1 K, 1.5 D

[56] References Cited

U.S. PATENT DOCUMENTS

| | | | |
|---|---|---|---|
| 2,322,212 | 6/1943 | Allen | 434/24 |
| 2,674,923 | 4/1954 | Brandt | 434/12 |
| 2,849,956 | 9/1958 | Johnson et al. | 102/70 |
| 3,112,671 | 12/1963 | Dunham et al. | 434/12 |
| 4,326,847 | 4/1982 | Roe | 434/12 |

*Primary Examiner*—William H. Grieb

*Attorney, Agent, or Firm*—Robert F. Beers; W. Thom Skeer; W. D. English

[57] ABSTRACT

A safe-arm simulator device for use in training personnel in maintaining and operating a missile rocket motor fuze safe-arm device of the type presently utilized on live missiles is disclosed. The device comprises a spring mounted on a rotatable shaft contained within a cylindrical housing. The housing is inserted in a bored hole of a dummy missile, exposing a key slot in the base of the shaft. A key is mounted on the device for turning the device from a safe to arm position. The spring offers resistance to turning similarly incurred in a live safe-arm device and likewise returns and maintains the device in a safe orientation unless locked in the arm position.

17 Claims, 3 Drawing Figures

SAFE-ARM TRAINING SIMULATOR

BACKGROUND OF THE INVENTION

1. Field of the Invention

This invention relates to the field of mechanics. More particularly, the invention relates to mechanical training devices. More specifically, the invention relates to a mechanical safe-arm training simulator for realistic training in the assembly and operation of a rocket-powered missile.

2. Description of the Prior Art

Various devices have been utilized in the past to prevent an explosive charge of a bomb or rocket motor of a missile from incurring an early or undesired detonation or firing. In particular, safety mechanisms inhibiting a bomb or missile from self-arming have been devised to prevent early detonation or firing when the bomb or missile is in storage, in transit, on the flight deck, or when in close proximity to the aircraft from which the bomb or missile is being deployed.

Such devices have included a simple wire lanyard passing through the arming fuze that must first be pulled free before fuze arming can take place. Other devices included a fuze lock and removable key concept, such that a key had to be inserted into the fuze, the fuze locked into arming position from a safety position with the key, and the key then subsequently removed to indicate that the fuze was armed. Experience, however, has proven that such mechanical lock and removable key devices did not have the reliability desired in arming a missile rocket motor; i.e. on occasion when the key was turned to the arm position, the safety mechanism sometimes switched back to safe from arm when the key was removed thereby creating a dud missile.

Consequently, a new generation lock and key device was developed specifically to prevent pre-ignition of the missile rocket motor, yet also increasing the reliability of the function of a safe-arm mechanism. This newly designed device included a non-removable key with a direct shaft length to the missile rocket motor fuze to increase reliability in arming the missile motor fuze.

A need has subsequently arisen to safely and economically train personnel in the handling and operation of this new safe-arm device for missile rocket motor fuzes. Since a missile containing either a live warhead or live rocket motor is not only highly dangerous to inexperienced personnel handling the missile, but also needlessly expensive in that a live missile contains a myriad of parts and components that are unnecessary for training with respect to the safe-arm device, there exists a continuing need to provide a simulated safe-arm device that can be adapted to a dummy missile containing none of the necessary equipment of a live missile. Such a safe-arm training device must, however, resemble in physical appearance and in tactile (torsional) feedback the actual safe-arm device used on live missiles.

The safe-arm training simulator described in the present application is such a device. It is designed to fit within the contours and apparatus presently used in a missile motor training environment. It further gives a realistic feel to an operator in arming the fuze of a missile rocket motor, and automatically returns and maintains the fuze in a safe configuration unless locked into an arm position in like manner that a live device would be operated.

SUMMARY OF THE INVENTION

The invention is a simulated safe-arm device for use in a training environment. It has a rotatable shaft and a spring under tension surrounding said shaft contained within a housing for insertion into a bored hole of a dummy missile. The shaft is provided with a key slot identical to that used in a live missile. When the key is assembled to the simulated safe-arm device, and turned from safe to arm position, a torsional resistive feel (tactile feedback) is provided by the spring. The spring also serves to return and maintain the shaft connected key in the safe position unless locked in the arm position.

OBJECTS OF THE INVENTION

One object of the invention is to provide a unit which will simulate mechanical arming of the rocket motor of a missile for use in a training missile program.

Another object is to design a unit that is compatible with the training missile design which also exhibits all the same physical exterior appearance characteristics as well as function (tactile feedback in turning, returning and maintaining device in a safe orientation), for training purposes to coincide with the tactical (live) version.

Still another object is to provide a device that mounts to the training missile by way of a bored hole in the missile tube versus mounting the device on a missile interior bulkhead or other missile interior components.

Yet another object is to provide a device that is simple and low-cost in design, operation, construction, and manufacture.

Still another object of the invention is to provide a safe-arm training simulator device that is resistant to corrosion, contains adjustable torsion means for arming simulation means, comprises simple installation, and is accessible from the exterior of an all up missile, thereby eliminating the need to disassemble the rocket motor.

Still a further object of the invention is to provide a device that limits rotation to 90°, offers arming resistance, returns to a safe position from an arm position when not properly armed, assures one-way operation only, and guarantees correct installation of a T-handle.

DESCRIPTION OF THE PREFERRED EMBODIMENT

Figure 1:
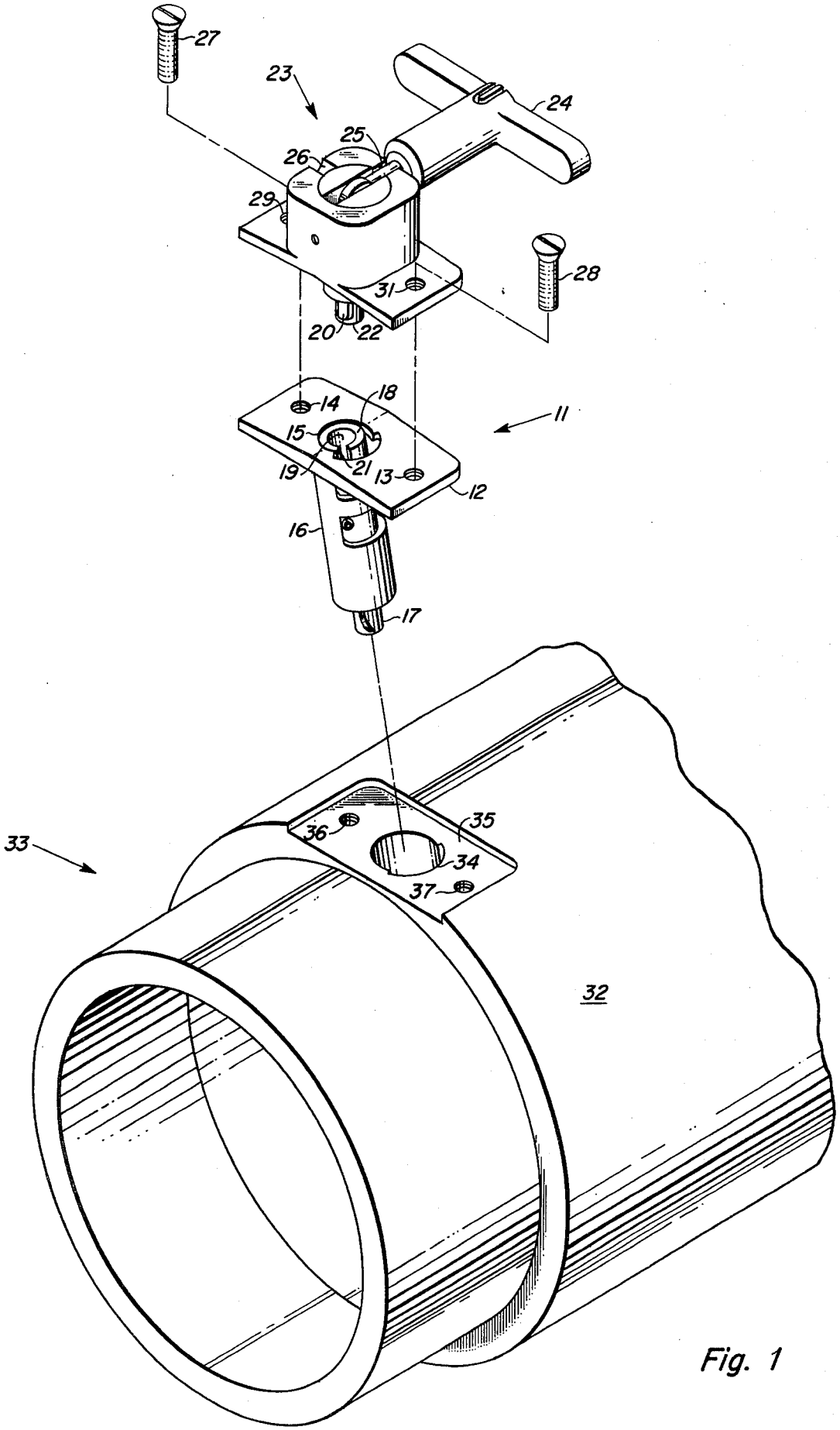
FIG. 1 illustrates the training simulator in relation to other training missile components.

FIG. 1 illustrates a disassembled, perspective view of the safe-arm training simulator 11 in relation to key device 23 and hollow dummy missile 33. Simulator 11 has a rectangular baseplate 12 which is provided with two simulator bolt holes 13 and 14 juxtaposed a large centrally positioned keyhole 15. A cylindrical housing 16 is bonded to and extends from keyhole 15 for containment of a rotatable shaft 17. An enlarged shaft base 18 of shaft 17 is provided with a circular key recess 19 and a key slot 21 for insertion therein of a key 22 having a key extension 20 of a key device 23.

Though key device 23 is not a claimed part of this invention, it is necessary to understand its role in the practical application of the invention, simulator 11. A key handle 24 of key device 23 is rotatably and pivotally attached to key 22, and can be lifted and locked in one of two handle slots 25 and 26. Handle slot 25 corresponds to an armed position, and handle slot 26 corresponds to a safe position.

Key 22 of key device 23 is positioned within key recess 19 of simulator 11 in such manner that key extension 20 fits snugly and properly within key slot 21. Two bolts 27 and 28, or other equivalent means for removable attachment, pass through key bolt holes 29 and 31 and subsequently through simulator bolt holes 13 and 14, respectively, for a firm coupling of key device 23 to simulator 11.

This subassembly is then inserted into a missile skin 32 of a hollow dummy missile 33. Missile 33 is also not a part of the claimed invention; however, it is the object in which this invention, simulator 11, is to be utilized. Housing 16 of simulator 11 is inserted within a bored hole 34 of missile skin 32. Baseplate 12 of simulator 11 is positioned within a rectangular skin recess 35 and is firmly bolted thereto by bolts 27 and 28 in missile bolt holes 36 and 37, respectively.

Figure 2:
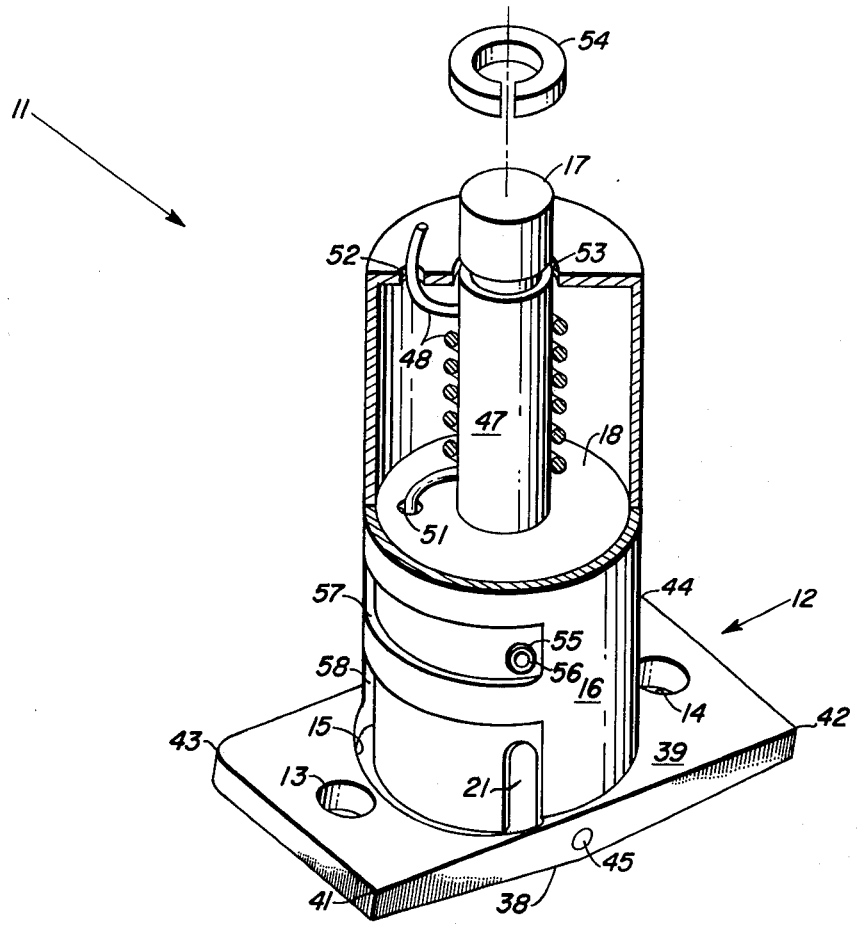
FIG. 2 illustrates a partly cutaway orthogonal view of the training simulator.

Referring now to FIG. 2, a more detailed description of simulator 11 is provided. Baseplate 12 is shown to have a slightly curved key mating surface 38 for one-way orientation to prevent the possibility that key device 23, described in FIG. 1, might be improperly positioned on simulator 11. Baseplate 12 is also provided with a flat missile mating surface 39 having two square corners 41 and 42 and two curved corners 43 and 44, again for one-way orientation of assembly. Simulator bolt holes 13 and 14, as indicated in FIG. 1, are again shown but on the opposite side of baseplate 12.

Housing 16 is positioned within keyhole 15 of baseplate 12 by a set pin 45, and is permanently bonded by conventional means thereto. In FIG. 2, housing 16 is shown in partial cutaway view 46 to expose shaft 17 having a slender cylindrical upper portion, shaft extension 47, surrounded by a coiled spring 48, and having a broad lower portion, shaft base 18, of such design that said shaft base 18 fits snugly but rotatably within housing 16.

Spring 48 is held in a tensioned, compressed state by housing 16, and is anchored at one end in a shaft hole 51 and anchored at its other end by housing spring hole 52 in such manner that when shaft 17 is turned, spring 48 tends to return shaft 17 to its original position (safe position).

Shaft extension 47 of shaft 17 extends snugly yet rotatably through a housing shaft hole 53 and is rotatably anchored from exit therethrough by a snap ring 54.

Shaft base 18 of shaft 17 is provided with a pinhole 55 for firm placement therein of a roll pin 56. Roll pin 56 permits 90° rotation of shaft 17 along a roll pin slot, first window 57, of housing 16. A second window 58 of housing 16 permits key extension 20 (FIG. 1) to be inserted through key slot 21 for rotating shaft 17 by 90° from the safe position indicated by roll pin 56 in FIG. 2 to an arm position on the opposite side of first window 57.

As pointed out earlier, spring 48 maintains and returns roll pin 56 to a safe position when shaft 17 is not locked in the arm position by key device 23.

Figure 3:
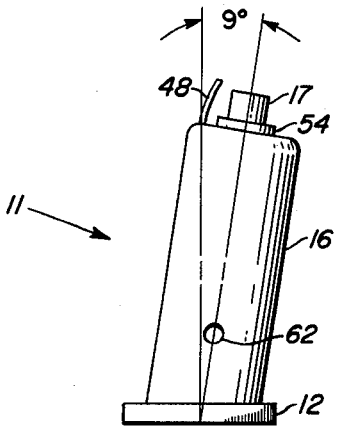
FIG. 3 illustrates a side elevational view of the training simulator.

Referring now to FIG. 3, a side elevational view of simulator 11 is illustrated. It can be seen that housing 16 is positioned at a 9° angle off the vertical of baseplate 12. Shaft 17 and snap ring 54 are likewise so situated for necessary design purposes in mating simulator 11 with missile 33. A circular pinhole 62 is provided in housing 16 at the roll pin 56 level for convenience in inserting and extracting roll pin 56 from pinhole 55.

MODE OF OPERATION

Referring again to FIG. 1, simulator 11 is utilized in a presently existing missile safe-arm training environment. Key device 23 is positioned on top of simulator 11 in such manner that bolt holes 29 and 31 align with bolt holes 14 and 13, respectively, and such that key 22 and key extension 20 of key device 23 align with key recess 19 and key slot 21 of simulator 11. The subassembly thusly obtained is then positioned in missile recess 35 in such manner that bolt holes 14 and 13 align with bolt holes 36 and 37, respectively, and such that housing 16 of simulator 11 extends through bored hole 34. The apparatus thus assembled is firmly bolted to missile 33 by insertion of bolts 27 and 28 in bolt holes 29 and 31, respectively. Simulator 11 is utilized as follows: FIG. 1 illustrates key handle 24 of key device 23 locked in the arm position, slot 25; i.e. rocket motor of missile 33 if it were a live missile is capable of firing. If key handle 34 is lifted to a vertical position, it can be turned counterclockwise and locked in handle slot 26 to be in the safe position; i.e. the rocket motor of a live missile could not be fired. In rotating key handle 24, key extension 20 within key slot 21 turns shaft 17. Spring 48 within housing 16 offers torsional resistance to such turning in an appropriate amount to simulate actual safe-arm hardware utilized in a live missile, and in addition tends to return shaft 17 and arm 24 to the safe position when key handle 24 of key device 23 is lifted from a locked arm position.

It is apparent from the foregoing that a highly practical safe-arm training simulator has been devised which is capable of giving long and continuous use, and which gives personnel utilizing the device a substantially authentic tactile feedback in operation of the safe-arm mechanism, yet at a substantial cost reduction otherwise incurred in training personnel to properly use safe-arm devices on live missiles.

It is to be understood that the form of the invention herewith shown and herein described, is to be taken as a preferred example of the same, and that various changes in shape, size and arrangement of parts may be resorted to without departing from the spirit of the invention, as is further evidenced by the attached drawings and the following claims.

What is claimed is:

1. A two-position, self-locking, safe-arm training device, comprising:

a baseplate having at least one hole through said baseplate;

a shaft mounted through said hole in said baseplate and having first and second holes in said shaft;

a spring mounted around said shaft and anchored at one end of said spring to said first hole in said shaft;

a housing mounted around said spring for keeping said spring under tension and for anchoring the other end of said spring, and having at least one roll slot in said housing;

a roll pin mounted in said second hole in said shaft and extending through said roll slot of said housing for confining said shaft in said housing, and for allowing said shaft to be switched between two set 90° positions, one of which corresponds to a safe position, and the other of which corresponds to an arm position, such that said spring returns said shaft to said safe position unless locked in said arm position.

2. In combination with a training missile and a safe-arm key, a mechanism to be used as a training device simulating a tactical safe-arm rocket motor fuze mechanism, including:

a baseplate mounted to said training missile;

a rotatable shaft mounted through said baseplate;

a housing extending from said baseplate and substantially enclosing said shaft;

a spring having first and second ends, mounted around said shaft and within said housing, said spring being anchored at said first end to said shaft and anchored at said second end to said housing;

means contained within said housing for confining rotation of said shaft within a 90° parameter; and means attached to said shaft for permitting insertion of said safe-arm key for rotation of said shaft.

3. The combination of claim 2, wherein said baseplate comprises a rectangular slab of machined stainless steel, having first and second broad surfaces.

4. The combination of claim 3, wherein said rectangular slab has a curved contour on a first broad surface for one-way mating with said safe-arm key.

5. The combination of claim 3, wherein said rectangular slab has a planar contour on a second broad surface for proper mating with said missile.

6. The combination of claim 3, wherein said rectangular slab has a centrally positioned hole for insertion therein and bonding thereto of said housing.

7. The combination of claim 3, wherein said rectangular slab has means for removably but firmly affixing said baseplate to said missile.

8. The combination of claim 7 wherein said affixing means comprises two bolt holes through said baseplate, one on either side of said centrally positioned hole, for insertion therethrough of two bolts.

9. The combination of claim 3, wherein said rectangular slab has two rounded corners and two square corners for one-way mating with said missile.

10. The combination of claim 2, wherein said rotatable shaft comprises a solid, machined stainless steel cylinder.

11. The combination of claim 10 wherein said steel cylinder comprises a first and a second part, said first part being of a diameter smaller than said second part and said second part having a recessed base with a slot extending therefrom.

12. The combination of claim 11 wherein said spring is coiled around said first part of said rotatable shaft.

13. The combination of claim 2, wherein said housing comprises a machined stainless steel, hollow cylinder having a circular hole at a first end and being open at a second end and having a diameter large enough to contain said rotatable shaft.

14. The combination of claim 13 wherein said first part of said shaft passes through said circular hole in said first end of said housing and said second part of said shaft passes through said open second end of said housing.

15. The combination of claim 13 wherein said housing is provided with a first and a second window in a 90° arc of the circumference of said housing.

16. The combination of claim 15, wherein said rotation confining means comprises a pin attached to said second part of said rotatable shaft and extending through said first 90° window of said housing.

17. The combination of claim 15 wherein said key insertion means comprises said recessed base and slot of said rotatable shaft juxtaposed said second window of said housing in such manner that said safe-arm key may be inserted therein and turned 90° from a safe position, maintained by said spring, to an arm position under torsional resistance of said spring.

* * * * *